US009512511B2

(12) United States Patent
Ishizuka et al.

(10) Patent No.: US 9,512,511 B2
(45) Date of Patent: Dec. 6, 2016

(54) METHOD FOR HOT-DIP GALVANIZING A STEEL SHEET

(75) Inventors: Kiyokazu Ishizuka, Himeji (JP); Kazumi Nishimura, Himeji (JP); Ikuo Kikuchi, Himeji (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 1347 days.

(21) Appl. No.: 11/911,883

(22) PCT Filed: Apr. 14, 2006

(86) PCT No.: PCT/JP2006/308371

§ 371 (c)(1),
(2), (4) Date: Nov. 24, 2008

(87) PCT Pub. No.: WO2006/112517

PCT Pub. Date: Oct. 26, 2006

(65) Prior Publication Data

US 2009/0200174 A1 Aug. 13, 2009

(30) Foreign Application Priority Data

Apr. 20, 2005 (JP) ..... 2005-121829

(51) Int. Cl.
*C23C 20/02* (2006.01)
*C25D 5/36* (2006.01)
(Continued)

(52) U.S. Cl.
CPC . *C23C 2/02* (2013.01); *C23C 2/06* (2013.01); *C23C 2/28* (2013.01)

(58) Field of Classification Search
CPC ..... C23C 2/02; C23C 18/08; C23C 18/1241; C23C 4/06; C23C 8/025; C23C 8/3225; C23C 2/04; C23C 2/06; C23C 2/08; C23C 2/10; C23C 28/02; B05D 3/0254
USPC ..... 427/329, 383.7, 406, 433; 205/217, 205/184, 228, 193
See application file for complete search history.

(56) References Cited

U.S. PATENT DOCUMENTS 3,730,758 A * 5/1973 Laidman ..... C23C 2/02 205/193
4,891,274 A * 1/1990 Higuchi ..... B32B 15/013 420/104

(Continued)

FOREIGN PATENT DOCUMENTS

EP 1466994 A1 10/2004
JP 04147953 5/1992

(Continued)

OTHER PUBLICATIONS

J.G. Herman et al., "Influence of Residual Elements on Steel Processing and Mechanical Properties," Iron and Steelmaker, pp. 35-42, Dec. 1996.

(Continued)

*Primary Examiner* — Edna Wong
(74) *Attorney, Agent, or Firm* — Birch, Stewart, Kolasch & Birch, LLP

(57) ABSTRACT

Exemplary embodiments of the present invention can provide a galvanization method for hot-rolled steel sheet, cold-rolled steel sheet, or plating sheet of various compositions, which can avoid nonplating defects by using an Ni preplating procedure. For example, an exemplary galvanization method can be provided for pickled hot-rolled steel sheet or annealed cold-rolled steel sheet which is free from non-plating defects which includes cleaning the surface of the plating sheet, preplating it with Ni, rapidly heating the sheet in a nonoxidizing or reducing atmosphere to a sheet temperature of about 430 to 500° C. at a heating a rate of about 20° C./sec or more, and then hot dip plating the sheet in a galvanization bath. The exemplary amount of Ni preplating can be determined based on the plate type and amount of Si in the sheet steel to produce a hot dip galvanization that is free from non-plating defects.

2 Claims, 1 Drawing Sheet

(51) Int. Cl.

| | |
|---|---|
| ***C25D 5/50*** | (2006.01) |
| ***C23C 2/02*** | (2006.01) |
| ***C23C 2/06*** | (2006.01) |
| ***C23C 2/28*** | (2006.01) |

(56) References Cited

U.S. PATENT DOCUMENTS

| | | | | |
|---|---|---|---|---|
| 5,203,985 | A | 4/1993 | Nishimura et al. | |
| 5,312,531 | A | 5/1994 | Nishimura et al. | |
| 6,436,555 | B1 * | 8/2002 | Nakajima et al. | 428/659 |
| 6,465,114 | B1 | 10/2002 | Honda et al. | |

FOREIGN PATENT DOCUMENTS

| | | | | | |
|---|---|---|---|---|---|
| JP | 04147953 | A | * | 5/1992 | C23C 2/06 |
| JP | 04333552 | | | 11/1992 | |
| JP | 04333552 | A | * | 11/1992 | C23C 2/06 |
| JP | 2517169 | | | 7/1996 | |
| JP | 2001064759 | | | 3/2001 | |
| JP | 2003183797 | A | * | 7/2003 | C23C 2/02 |
| JP | 2003268519 | | | 9/2003 | |
| JP | 2003293108 | | | 10/2003 | |

OTHER PUBLICATIONS

T. Yamada et al., "Effects of Cu, Ni, Cr and Sn on Mechancial Properties of Ti added Extra Low C Steel Sheet," Iron and Steelamaker, vol. 79, pp. 973-979, 1993.

T. Yamada et al., "Effects of Cu, Ni, Cr and Sn on Mechancial Properties of Ti-added Extra-Low C Steel Sheet (Effect of Tramp Elements on Properties of Continuous Annealed Steel Sheet-I)", Camp-ISIJ vol. 4(1991)-1935.

English translation of the Brazilian Search Report and Written Opinion for Brazilian Application No. PI0608494-0, dated Aug. 2, 2016.

* cited by examiner

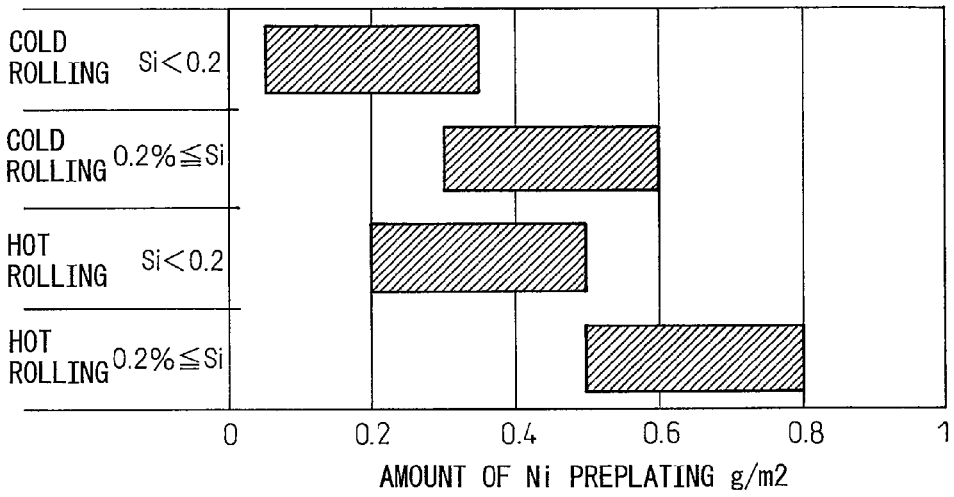
COLD ROLLING Si<0.2
COLD ROLLING 0.2%≦Si
HOT ROLLING Si<0.2
HOT ROLLING 0.2%≦Si
0
0.2
0.4
0.6
0.8
1
AMOUNT OF Ni PREPLATING g/m2

METHOD FOR HOT-DIP GALVANIZING A STEEL SHEET

CROSS-REFERENCE TO RELATED APPLICATIONS

This application is a national stage application of PCT Application No. PCT/JP2006/308371 which was filed on Apr. 14, 2006, and published on Oct. 26, 2006 as International Publication No. WO 2006/112515. This application claims priority from the International Application pursuant to 35 U.S.C. §365, and from and from Japanese Patent Application No. 2005-121829, filed Apr. 20, 2005, under 35 U.S.C. §119. The entire disclosures of the above-referenced applications are incorporated herein by reference in their entireties.

FIELD OF THE INVENTION

The present invention relates to a hot-dip galvanization method using an Ni preplating technique for hot-rolled steel sheet and cold-rolled steel sheet as a plating sheet, where the resulting hot-dip galvanization is free from nonplating defects for various types of plating sheets.

BACKGROUND INFORMATION

Hot-dip galvanized steel sheet can exhibit superior corrosion resistance. Accordingly, such steel sheets can often be used for automobiles, household electric appliances, building materials, and other various types of applications. In the past, building material applications were most common, but progress in operating technology has facilitated a reduction of dross-based defects in appearance. Thus, such sheet can now be used in large volumes in applications such as automobiles and household electric appliances, which may have stringent require requirements for appearance quality. As a result of these varied applications and requirements, diverse types of plating sheets may often be used. For example, a hot-dip galvannealized steel sheet obtained by heat treating hot-dip galvanized steel sheet can exhibit superior weldability as compared with hot-dip galvanized steel sheet. Such galvannealized steel sheet is being used in increasingly large volumes, particularly for automobile applications.

A method of utilizing Ni preplating to produce hot-dip galvanized steel sheet which can exhibit superior plating adhesion and corrosion resistance of worked parts is described, e.g., in Japanese Patent No. 2517169, the entire disclosure of which is incorporated herein by reference. However, the method described in this Japanese patent may not provide optimum plating conditions for the wide range of plating sheets commonly used such as those described above. Thus, there may be a need for an improved galvanization method which can be used for a wide range of plating sheets and applications.

SUMMARY OF EXEMPLARY EMBODIMENTS OF THE INVENTION

Exemplary embodiments of a galvanization method according to the present invention may be provided which can use a Ni preplating technique and which may be advantageous with respect to production costs. Such exemplary method may also be free from nonplating defects when applied to a variety of plating sheets.

When performing the exemplary galvanization method using a Ni preplating technique for various types of plating sheets (e.g., hot-rolled steel sheet or cold-rolled steel sheet), the amount of Ni preplating may be adjusted based on the type of plating sheet used to obtain hot-dip galvanization that is free from nonplating defects. For example, the exemplary galvanization method can include: (a) cleaning the surface of a plating sheet; (b) preplating it with Ni, rapidly heating it in a nonoxidizing or reducing atmosphere to a sheet temperature between about 430 and about 500° C. at a temperature rise rate of about 20° C./sec or more; and (c) then hot-dip plating it in a galvanization bath. Such exemplary method may utilize an adjustment to the amount of preplated Ni which may be used to obtain hot-dip galvanization that is free from nonplating defects. Such exemplary techniques can also be applied to various types of alloy plating including, e.g., Zn.

For example, when the plating sheet is a pickled hot-rolled steel sheet and the steel sheet includes about 0.2% or more of Si, the amount of Ni preplating to prevent nonplating defects can be about 0.5 $g/m^2$ or more. If the plating sheet is a pickled hot-rolled steel sheet and there is less than about 0.2% Si in the steel sheet, the amount of Ni preplating to prevent nonplating defects can be about 0.2 $g/m^2$ or more. As a further example, when the plating sheet is an annealed cold-rolled steel sheet and the steel sheet includes about 0.2% or more of Si, the amount of Ni preplating to prevent nonplating defects can be about 0.3 $g/m^2$ or more. Also, when the plating sheet is an annealed cold-rolled steel sheet and there is less than about 0.2% Si in the steel sheet, the amount of Ni preplating to prevent nonplating defects can be about 0.05 $g/m^2$ or more.

According to exemplary embodiments of the present invention, it may be possible to hot-dip galvanize a hot-rolled steel sheet, cold-rolled steel sheet, or plating sheet having various compositions without producing any nonplating defects.

These and other objects, features and advantages of the present invention will become apparent upon reading the following detailed description of embodiments of the invention, when taken in conjunction with the appended claims.

BRIEF DESCRIPTION OF THE DRAWING

Further objects, features and advantages of the invention will become apparent from the following detailed description taken in conjunction with the accompanying FIGURE showing illustrative embodiments, results and/or features of the exemplary embodiments of the present invention, in which:

FIG. 1 is a graph of exemplary Ni preplating ranges for various plate types in accordance with exemplary embodiments of the present invention.

DETAILED DESCRIPTION OF EXEMPLARY EMBODIMENTS OF THE INVENTION

In exemplary embodiments of the present invention, both hot-rolled steel sheet and cold-rolled steel sheet can be used as plating sheets. "Hot-rolled steel sheet" can include, but is not limited to, e.g., a steel sheet in which a surface layer may not include residual scale (e.g., "black oxide material"), but where the scale may have been removed by a pickling treatment. "Cold-rolled steel sheet" can include, but is not limited to, e.g., both materials which are cold rolled but not yet annealed, and annealed materials. As described herein, a pretreatment for an exemplary hot-dip galvanization in accordance with exemplary embodiments of the present invention may likely not anneal unannealed materials. Thus, it may be undesirable to cover cold rolled but not yet annealed materials using certain exemplary embodiments of the present invention unless there is some certain need or requirement. "Cold rolled annealed materials" can include, but are not limited to, e.g., materials produced using conventional techniques. However, the exemplary steel sheet which is cooled using water (e.g., by "water vaporization cooling") may have residual scale on the surface layer, so the sheet may preferably one from which scale has been removed by pickling.

According to exemplary embodiments of the present invention, any of the plating sheets described herein can be hot-dip galvanized without exhibiting nonplating defects by adjusting the amount of Ni preplating. Thus, a cleaning pretreatment can first be performed to clean away surface dirt, oxide film, etc. before preplating a sheet with Ni. For example, a cleaning pretreatment which may include, e.g., alkali degreasing followed by a pickling treatment may be preferable.

In accordance with exemplary embodiments of the present invention, the amount of Ni preplating may vary with the type of plating sheet used. For example, when the plating sheet is pickled hot-rolled steel sheet, the amount of Ni preplating can be about 0.2 $g/m^2$ or more. If less than this amount of Ni is preplated, nonplating defects may result. Further, hot-rolled steel sheet made of steel which contains about 0.2% or more Si may be more susceptible to nonplating defects, so the amount of Ni preplating used to avoid such defects can be about 0.5 $g/m^2$ or more. For example, when galvanizing a cold-rolled steel sheet, the amount of Ni preplating can also be about 0.05 $g/m^2$ or more. If less than this amount of Ni is preplated, nonplating defects may result. Further, a cold-rolled steel sheet where the steel contains about 0.2% or more Si may also be more susceptible to nonplating defects, so the amount of Ni preplating can be about 0.3 $g/m^2$ or more to avoid such defects.

An exemplary upper limit of the amount of Ni preplating may not be particularly limited, but an exemplary lower amount of Ni preplating may be preferable based on cost considerations. Thus, it may be preferable to use upper limit conditions for the amount of preplated Ni such that the amount actually preplated may not fall below the above-mentioned lower limit values, based on the capacity of the Ni preplating system used. For example, with an exemplary electroplating facility, sufficient control may be possible within a range of about 0.3 $g/m^2$, such that if the lower limit is set to 0.05 $g/m^2$, an actual preplating range of about 0.05 to 0.35 $g/m^2$ can be achieved. Further, if the lower limit is set to 0.5 $g/m^2$, an actual preplating range of about 0.5 to 0.8 $g/m^2$ or so can be achieved.

Certain advantageous levels of Ni preplating which may be determined in accordance with exemplary embodiments of the present invention, e.g., based on cost considerations, are shown in FIG. 1. For example, FIG. 1 shows a preferable range of the amount of Ni preplating for two types of plating sheets for two different concentration ranges of Si.

After Ni preplating, a sheet can be rapidly heated in a nonoxidizing or reducing atmosphere to a sheet temperature of between about 430° C. and 500° C., at a heating rate of about 20° C./sec or more. Such treatment can secure wettability of the hot-dip plating or plating adhesion. After this heating procedure, the sheet can be hot-dip galvanized and wiped to adjust the basis weight.

Various conventional hot-dip galvanization baths may be applied, including alloy plating baths containing Zn. For example, by including between about 0.05% and 1.0% Al in a hot-dip galvanization bath, hot-dip galvanized steel sheet exhibiting a good plating adhesion can be produced due to the action of Al. Also, by further including between about 0.01% and 1.0% Mg in the bath, hot-dip galvanized steel sheet with a good corrosion resistance can be produced. Further, Ni, Co, Ti, Pb, Bi, Sb, Sn, Si, etc. may be added to the bath in small amounts of between about 0.001 to 0.1%. A hot-dip galvannealed steel sheet can be produced, e.g., by heat treating a hot-dip galvanized steel sheet, produced as described above, using conventional heat treatment techniques.

Between about 1% and 15% of Al can be included in the hot-dip galvanization bath to obtain a Zn—Al hot-dip galvannealed steel sheet which exhibits good corrosion resistance. In addition, between about 1.0% and 5.0% Mg may also be included in the bath to obtain a Zn—Al—Mg hot-dip galvannealed steel sheet which can exhibit even better corrosion resistance. Further, between about 0.01% and 1.0% Si can be included in the bath to obtain an exemplary Zn—Al—Mg—Si hot-dip galvannealed steel sheet which may exhibit still better corrosion resistance.

Further, it is possible to include Al in a large amount of about 15% to 80% in the hot-dip galvanization bath to obtain an even better corrosion resistance Zn—Al hot-dip galvannealed steel sheet. Further, it is possible to include Si in an amount of 0.01% to 1.0% to obtain a still further corrosion resistance Zn—Al—Si hot-dip galvannealed steel sheet.

EXAMPLES

The seven types of exemplary plating sheets characterized in Table 1 were used in exemplary galvanizing procedures. Plating sheets 1 to 4 were annealed cold-rolled steel sheets, while plates 5 and 6 were pickled hot-rolled steel sheets. These test sheets were pretreated under the conditions described in Table 2, then electroplated in plating baths having the composition shown in Table 3. The electroplating bath temperature was about 60° C., and the current density was about 30 $A/dm^2$ for Ni preplating. After the preplating procedure, the test sheets were heated in a 3% $H_2$+$N_2$ atmosphere at a heating rate of about 50° C./sec to a temperature of about 460° C. The test sheets were then immediately dipped in a hot-dip galvanization bath maintained at a temperature of about 450° C., and held there for about 3 seconds. The test sheets were then wiped to adjust the basis weight to about 60 $g/m^2$.

Table 4 shows various test plating configurations and observations of plating appearance. For example, in Example 1 and Comparative Examples 1a and 2a, the hot-dip plating baths used included about 0.2% of added Al. The amount of Ni preplating used in Example 1, as shown in Table 4, was different for each plating sheet. In Comparative Example 1a and Comparative Example 2a, as shown in Table 4, the amount of Ni preplating was the same for each plating sheet.

In Example 2, the hot-dip plating bath had about 0.2% of Al and about 0.5% of Mg added. The amount of Ni preplating, as shown in Table 4, was different for each plating sheet.

In Example 3, the hot-dip plating bath had about 10% of Al, about 3% of Mg, and about 0.2% of Si added. The amount of Ni preplating, as shown in Table 4, was different for each plating sheet.

In Example 4, the hot-dip plating bath had about 55% of Al and 0.2% of Si added. The amount of Ni preplating, as shown in Table 4, was different for each plating sheet.

Each sample was plated, visually observed for appearance, and checked for the presence of any nonplating defects or other abnormalities. As shown in Table 4, any type of sheet which was plated using conditions in accordance with exemplary embodiments of the present invention exhibited a good plating appearance after hot-dip galvanizing.

TABLE 1

Test Sheets

| Sheet | Steel sheet Type | Steel ingredients (mass %) C | Si | Mn | P | S | Ti |
|---|---|---|---|---|---|---|---|
| Sheet 1 | Cold rolling | 0.002 | 0.01 | 0.15 | 0.014 | 0.006 | 0.03 |
| Sheet 2 | Cold rolling | 0.002 | 0.09 | 1.08 | 0.015 | 0.012 | 0.007 |
| Sheet 3 | Cold rolling | 0.14 | 0.24 | 1.4 | 0.017 | 0.008 | — |
| Sheet 4 | Cold rolling | 0.07 | 0.45 | 1.87 | 0.015 | 0.006 | — |
| Sheet 5 | Hot rolling | 0.045 | 0.015 | 0.21 | 0.16 | 0.009 | — |
| Sheet 6 | Hot rolling | 0.07 | 0.69 | 2.38 | 0.007 | 0.001 | — |
| Sheet 7 | Hot rolling | 0.2 | 1.58 | 1.59 | 0.009 | 0.001 | — |

TABLE 2

Pretreatment Conditions

| | | |
|---|---|---|
| Alkali degreasing treatment | NaOH | 50 g/l |
| | Solution temperature | 65° C. |
| | Dipping | 10 sec |
| Pickling treatment | $H_2SO_4$ | 90 g/l |
| | Solution temperature | 60° C. |
| | Dipping | 5 sec |

TABLE 3

Ni Preplating Conditions

| Ingredients | Concentration |
|---|---|
| $NiSO_4 \cdot 6H_2O$ | 300 g/l |
| $H_3BO_3$ | 40 g/l |
| $Na_2SO_4$ | 100 g/l |
| pH | 2.7 |

TABLE 4

Results of Evaluation

| | | Hot-dip plating bath | Sheet | Amount of Ni preplating g/m$^2$ | Plating Appearance |
|---|---|---|---|---|---|
| Ex. | 1 | Zn—0.2%Al | Sheet 1 | 0.05 | Good |
| | | | Sheet 2 | 0.05 | Good |
| | | | Sheet 3 | 0.3 | Good |
| | | | Sheet 4 | 0.3 | Good |
| | | | Sheet 5 | 0.2 | Good |
| | | | Sheet 6 | 0.5 | Good |
| | | | Sheet 7 | 0.5 | Good |
| Comp. Ex. | 1a | Zn—0.2%Al | Sheet 1 | 0.1 | Good |
| | | | Sheet 2 | " | Good |
| | | | Sheet 3 | " | Poor |
| | | | Sheet 4 | " | Poor |
| | | | Sheet 5 | " | Poor |
| | | | Sheet 6 | " | Poor |
| | | | Sheet 7 | " | Poor |
| Comp. Ex. | 2a | Zn—0.2%Al | Sheet 1 | 0.2 | Good |
| | | | Sheet 2 | " | Good |
| | | | Sheet 3 | " | Poor |
| | | | Sheet 4 | " | Poor |
| | | | Sheet 5 | " | Good |
| | | | Sheet 6 | " | Poor |
| | | | Sheet 7 | " | Poor |
| Ex. | 2 | Zn—0.2%Al—0.5% Mg | Sheet 1 | 0.05 | Good |
| | | | Sheet 2 | 0.05 | Good |
| | | | Sheet 3 | 0.3 | Good |
| | | | Sheet 4 | 0.3 | Good |
| | | | Sheet 5 | 0.2 | Good |
| | | | Sheet 6 | 0.5 | Good |
| | | | Sheet 7 | 0.5 | Good |
| Ex. | 3 | Zn—10%Al—3%Mg—0.2%Si | Sheet 1 | 0.05 | Good |
| | | | Sheet 2 | 0.05 | Good |
| | | | Sheet 3 | 0.3 | Good |
| | | | Sheet 4 | 0.3 | Good |
| | | | Sheet 5 | 0.2 | Good |
| | | | Sheet 6 | 0.5 | Good |
| | | | Sheet 7 | 0.5 | Good |
| Ex. | 4 | Zn—55%Al—0.2%Si | Sheet 1 | 0.05 | Good |
| | | | Sheet 2 | 0.05 | Good |
| | | | Sheet 3 | 0.3 | Good |
| | | | Sheet 4 | 0.3 | Good |
| | | | Sheet 5 | 0.2 | Good |
| | | | Sheet 6 | 0.5 | Good |
| | | | Sheet 7 | 0.5 | Good |

INDUSTRIAL APPLICABILITY

The exemplary embodiments of the present invention can be utilized in a hot-dip galvanization facility using the Ni preplating method and can be applied to any of the diverse types of plating sheets used for various types of applications such as automobiles, household electric appliances, building materials, etc.

The invention claimed is:

1. A galvanization method for providing a plating sheet containing less than 0.09% Si, which is an annealed cold-rolled steel sheet, and which is configured to avoid non-plating defects, the method comprising:

an alkali degreasing treatment of the steel sheet;

a pickling treatment of the alkali degreased steel sheet in a sulfuric acid aqueous solution;

electroplating the pickled steel sheet with Ni in a sulfate ion containing plating bath;

preparing the electroplated steel sheet by heating said electroplated steel sheet in a reducing atmosphere to a sheet temperature between about 430° C. and about 500° C. at a heating rate between 20° C./sec and 50° C./sec; and hot-dip plating the prepared steel sheet in a galvanization bath comprising between about 0.05% and about 1.0% Al, wherein an amount of Ni applied during the electroplating is between about 0.05 $g/m^2$ and about 0.1 $g/m^2$.

2. The method of claim 1, further comprising further heating the hot-dipped prepared steel sheet and performing an alloying treatment.

* * * * *